US010629166B2

(12) United States Patent
Boyce

(10) Patent No.: US 10,629,166 B2
(45) Date of Patent: Apr. 21, 2020

(54) VIDEO WITH SELECTABLE TAG OVERLAY AUXILIARY PICTURES

(71) Applicant: Intel Corporation, Santa Clara, CA (US)

(72) Inventor: Jill MacDonald Boyce, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 872 days.

(21) Appl. No.: 15/088,536

(22) Filed: Apr. 1, 2016

(65) Prior Publication Data

US 2017/0287443 A1 Oct. 5, 2017

(51) Int. Cl.
*G09G 5/377* (2006.01)
*G09G 5/00* (2006.01)

(52) U.S. Cl.
CPC ..... *G09G 5/377* (2013.01); *G09G 5/006* (2013.01); *G09G 2320/103* (2013.01); *G09G 2340/125* (2013.01)

(58) Field of Classification Search
None
See application file for complete search history.

(56) References Cited

U.S. PATENT DOCUMENTS 9,264,686 B2 2/2016 Barton et al.
2001/0023436 A1* 9/2001 Srinivasan ..... G11B 27/031 709/219
2002/0122136 A1 9/2002 Safadi et al.
2009/0324022 A1 12/2009 Sangberg et al.
2013/0314441 A1* 11/2013 Grasset ..... G06T 1/00 345/633
2015/0033126 A1 1/2015 Shin
2015/0195571 A1 7/2015 Boyce et al.
2016/0057488 A1* 2/2016 Smolic ..... H04N 21/44016 725/32
2016/0057508 A1 2/2016 Borcherdt
2016/0109954 A1* 4/2016 Harris ..... G06F 3/017 345/156

(Continued)

FOREIGN PATENT DOCUMENTS

KR 10-2015-0011651 2/2015

OTHER PUBLICATIONS

Nikolce Stefanoski, et el,, MV-HEVC/SHVC HLS: Proposal for an SES message on selectable overlays, Joint Collaborative Team on Video Coding, Joint Collaborative Team on 3D Video Coding Extensions, Apr. 4, 2014, 10 pages. (Year: 2014).*

(Continued)

*Primary Examiner* — Xiao M Wu
*Assistant Examiner* — Steven Z Elbinger
(74) *Attorney, Agent, or Firm* — Finch & Maloney PLLC

(57) ABSTRACT

Video is described with selectable tag overlay auxiliary pictures. In one example video content is prepared by identifying an object in a sequence of video frames, generating a tag overlay video frame having a visible representation of a tag in a position which is related to the position of the identified object, generating an overlay label frame to indicate pixel positions corresponding to the tag of the tag overlay frame, and encoding the video frame, the tag overlay video frame and the overlay label frame in an encoded video sequence.

20 Claims, 7 Drawing Sheets

(56) References Cited

U.S. PATENT DOCUMENTS

2016/0150196 A1* 5/2016 Horvath ..... H04N 5/247
348/211.4
2016/0171296 A1* 6/2016 Ikenoue ..... G06K 9/6204
382/103

OTHER PUBLICATIONS

Nikolce Stefanoski, et al., MV-HEVC/SHVC HLS: Proposal for an SEI message on selectable overlays, Joint Collaborative Team on Video Coding, Joint Collaborative Team on 3D Video Coding Extensions, Apr. 4, 2014, 10 pages.
PCT International Search Report and Written Opinion of the International Searching Authority for International Application No. PCT/US2017/013444, dated May 24, 2017, 12 pages.

* cited by examiner

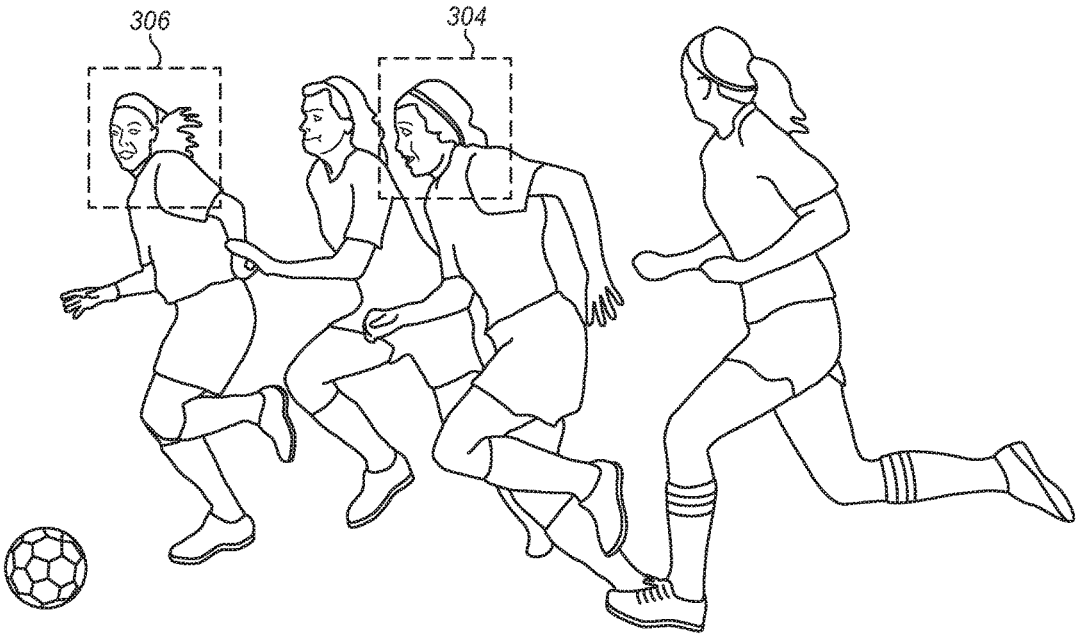
FIG. 3
FIG. 4
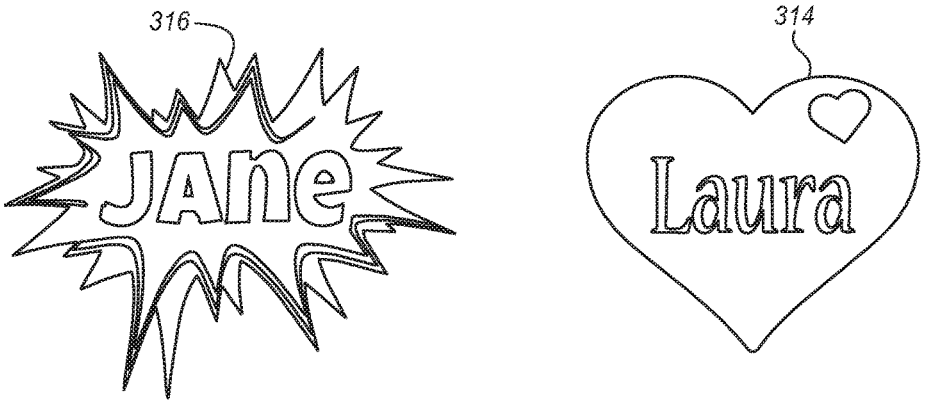

VIDEO WITH SELECTABLE TAG OVERLAY AUXILIARY PICTURES

FIELD

The present description relates to the field of video encoding and decoding and, in particular, to tag overlays that may be selected by a viewer.

BACKGROUND

In video presentation additional information is often presented with the video as an overlay. Such overlays are used in television, scientific observation, surveillance and many other fields. Common overlays provide sports scores and statistics, news tickers, legends to identify a player, a speaker, an object on the screen, or some other background or contextual information for the video. Typically the overlays are added during a production or a post-production stage and are a part of the video. They cannot be removed, changed or added to by the viewer.

Visual tags identifying the presence and location of still or moving objects are built in to many video editing tools. Some video editing tools even have a motion tracking feature that allows a tagging graphic to be added to the video that follows the position of a moving object. Motion tracking software can be used to follow an object in the video after an editor tags that object. The tagging graphic is then composited onto the video content and will be seen whenever the composite video is played.

Selectable overlays have been developed as overlays that a viewer can select to turn on and off. This may have benefits for those viewers that wish to see more of the video without the selectable overlay blocking a portion of the screen. To allow an overlay to be turned off, the overlay is presented separate from the video data. Overlays may be sent over separate transmission channels or separately as embedded metadata. Additional rendering capabilities are used at the receiver, such as a set-top box or display, to render a pixel representation from the metadata. The production workflows are modified for selectable overlays to render the overlays in a separate format, such as meta-data.

BRIEF DESCRIPTION OF THE DRAWING FIGURES

The material described herein is illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity.

FIG. 3 is a diagram of a video frame with bounding boxes to indicate identified objects according to an embodiment.

FIG. 4 is a diagram of an overlay frame created by an object tagger according to an embodiment.

DETAILED DESCRIPTION

As described herein a viewer is able to control the display of video tagging overlays of moving and stationary objects while watching a video. Visual tags identifying the presence and location of moving objects can be associated with video content, and displayed as an overlay over the video content. When the visual tags are overlaid onto the video content prior to encoding and transmitting the video, the visual tags will always be displayed, which can be annoying to a viewer when the visual tags are not desired. The techniques and systems described herein allow the viewer to select whether or not to display individual visual tags during viewing.

In some embodiments, a video content preparation unit detects and tracks moving objects in video content and creates an overlay containing visual tags corresponding to each tracked moving object that is present in the video content frame. Overlay auxiliary pictures, such as those supported in the HEVC (High Efficiency Video Coding) version 2 standard (promulgated by ITU-T Video Coding Experts Group of the International Telecommunication Union), are used to encode the overlay, with each separate tracked object represented as a separate overlay element.

A playback unit decodes and displays the content video, and provides a user interface for a viewer to select which, if any, tracked objects to display visual tags for, by displaying only the overlay elements associated with the selected tracked objects. Similar techniques can be applied to other similar coding systems, including variations and further developments of HEVC and H.265 from ITU-T, among others.

Figure 1:
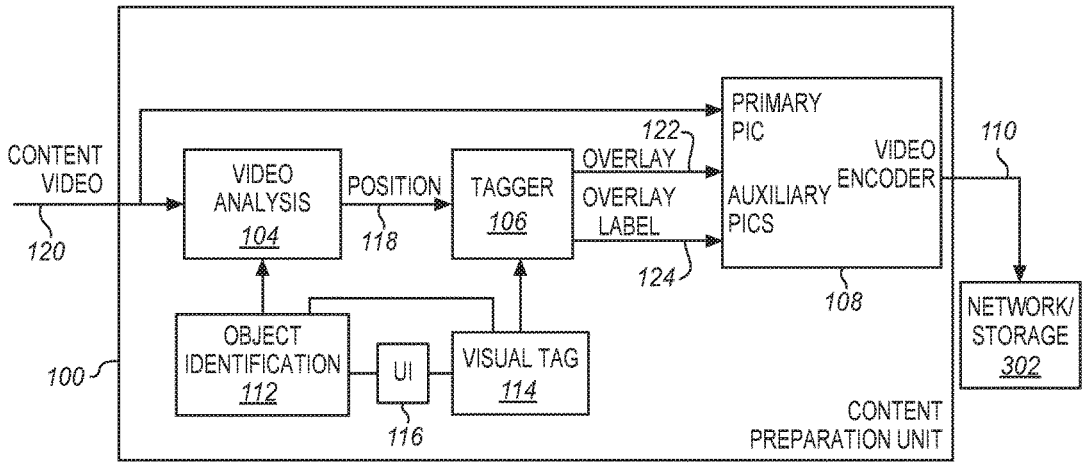
FIG. 1 is a block diagram, of an example content preparation unit with an object tagger according to an embodiment.

FIG. 1 is a block diagram of an example content preparation unit. The content preparation unit 102 prepares the video which is then sent to a playback unit 202. A storage or distribution network 302 conveys the video from preparation to playback. The content preparation unit 102 contains a video analysis module 104, a tagger module 106, and a video encoder 108. The content preparation unit may be a professional video editing workstation or network or smaller more convenient device from a personal computer, to a video camera, to a portable smart phone. The content preparation unit may also be hosted on servers with remote access by users that provide the video to edit.

Figure 2:
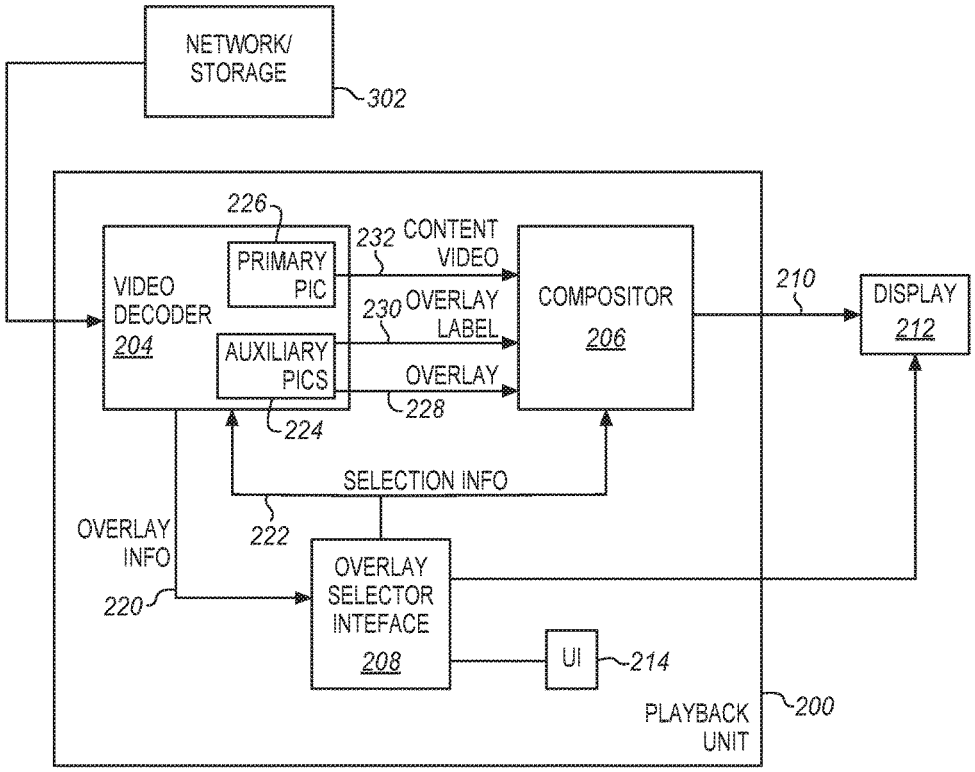
FIG. 2 is a block diagram of an example of a content playback unit with an overlay selection interface according to an embodiment.

In this example, the content preparation unit creates a video bitstream 110 which contains representations of the content video and of an overlay containing visual tags corresponding to tracked objects. As described in more detail below and shown in FIG. 2, the playback unit 202 receives and processes the video bitstream, and based upon a user interface to select overlays, composites the content video with regions of the overlay corresponding to selected visual tags as auxiliary pictures, to display the composited video.

Content video 120 is received at the content preparation unit 102. This video may be stored in a mass storage device for later post processing or received directly from a camera. The video analysis module 104 analyzes the received content video to identify one or more objects, and to track those objects throughout the video. An object identification module 112 identifies objects of interests and tracks them through the frames of the video. The initial object identification may be user controlled through a GUI (Graphical User Interface) 116 that is connected to the object identification module, or the object identification may be automatic.

For example, if a GUI is used, a user may use a mouse to draw an outline around an object in a frame. The object identification module 112, may then automatically identify the boundaries of that object and track that object as it moves through other frames in the sequence. When the tracked objects are people, then facial recognition may be used to identify the person. For some tracking systems, training is previously done on images of the person. This training is used to continue to identify the person through the frames of the video sequence.

The object identification module 112 is connected to the video analysis 104. For each frame in the content video, the object identification module determines if each tracked object is present, and if the object is present, then the object identification module determines the location of the object in the respective frame. The tracked objects may be selected by a user or operator through the UI 116 or all identified objects may be tracked. The location may be identified as a simple rectangular bounding box identified by the four corner positions of the bounding box. Alternatively, the location may be more precise, with a per pixel or per block indication of the object or the object contour. These operations are done in the video analysis module 104, which has as inputs the content video 120 and any object identifying information 112. The video analysis module 104 outputs position data for each object that is presently being tracked.

For each tracked object, a visible tag representation 118 is input to the tagger module 106. This tag may be a display name or an icon which will be static throughout the video sequence, or a moving icon such as a rotating logo. The visible tag may also change dynamically with the moving object, such as an indication of the entire shape of the object or a moving contour of the object, which is updated with each frame of the content video.

In the tagger module 106, a tag overlay video frame is generated which contains a visible representation of a tag for each tracked object and for each frame, when that object is present in the frame. The visible representation is placed in each frame in a position that tracks the object. The position of the tag is based upon a position input from the analysis module 104. For example, a person's name or icon may be displayed in a position near to the tracked object corresponding to that person. The tag overlay frame changes for each frame so that the tag moves in each frame along with the person or with any other tracked object. The position of the tag is determined by the tracked object position determined in the video analysis unit, possibly with an offset so that the tag is positioned nearby but not on top of the tracked object, or in the case of a contour, in the same position as the object itself. The motion tracking from the video analysis adjust the position of the tag overlay from frame to frame based on the motion of the object. This allows each overlay frame to be combined with the corresponding primary picture frame in the video sequence.

The visible representation is supplied by a visual tag generator 114. This tag generator may receive a tag from an operator or editor through the GUI 116. Alternatively, the tag may be generated by the object identification 112. The identification of objects may be for a particular class of objects or a particular individual from among the class. In other words the object identifier may identify a particular object as a sports team member or more specifically as Jane.

An overlay label frame is also generated by the tagger 106, that indicates which overlay element, if any, is represented for each pixel in the tag overlay video frame. There may be an overlay label frame for each overlay frame. The overlay label frame allows the user to identify the tags and to select and de-select a tag as described in more detail below.

In some embodiments, the overlay label frame corresponds to the format used in HEVC version 2 (IUT-T H.265) auxiliary pictures using the overlay info SEI (Supplemental Enhancement Information) message. In HEVC version 2, the overlay info SEI message is used to describe the contents of auxiliary pictures containing overlay content and overlay labels, and optionally, an overlay alpha. An overlay can contain multiple overlay elements. The SEI message contains a name for each overlay, and a name for each overlay element. The overlay label frame is used to identify which pixels of the overlay content frame correspond to which overlay element. Pixel values within certain brightness ranges correspond to particular overlay elements. For example, brightness values of 10 to 20 could correspond to a first element, and values of 20 to 30 could correspond to a second element.

Positions in the tag overlay video frame correspond to positions in the content video. The tag overlay video frame and overlay label may either be the same resolution as the content video, or may be a smaller resolution and use scaling factors and/or scaled reference offsets, as defined in HEVC version 2, to provide the corresponding position in the content video. Scaled reference offsets may be used with a bounding rectangle containing all overlay elements to create a smaller frame, with four parameters used to indicate the left, top, right, and bottom offsets between the smaller frame and the full-size frame. Reducing the size of the overlay and overlay label frames compared to the content video frames has a benefit of reducing encoding and decoding complexity for the auxiliary pictures of the overlay frames.

The content video 120, tag overlay 122, and overlay label 124 layers are encoded as auxiliary pictures with each video frame using a video encoder 108. The video encoder receives these components and then combines them into a single output encoded video stream 110. The video stream may be stored 302 at a network center and then streamed, broadcast, or multicast to viewers for consumption on remote playback units 202. Alternatively, the video stream may be stored locally for local playback on a local playback unit 202.

In some embodiments, the video encoder is an HEVC version 2 encoder, and the encoded video may be contained within a single bitstream. This bitstream may be transmitted or stored until accessed by the player unit. The original content video is encoded into a sequence of primary pictures. The primary pictures are coded in one or more layers using traditional layered coding tools to represent the original content video. The tag overlay and overlay label frames from the tagger 106 are encoded as auxiliary picture layers. The auxiliary pictures may be coded in a scalable layer in the sense that each auxiliary picture has a layer_id that is distinct from the layers used for the primary picture. There may be many auxiliary pictures for each primary picture. The auxiliary pictures may be scalably coded, using inter-layer prediction from other auxiliary picture layers of the same auxiliary picture type. The auxiliary pictures may include overlay pictures which are samples that overlay the samples in the primary picture. The auxiliary pictures may also include overlay layout pictures that indicate the presence of overlay samples from one or more overlay pictures at locations indicated by the overlay layout picture.

If HEVC or a similar type of encoder is used as the video encoder 110, an overlay info SEI message may be used to indicate that an overlay is present which contains one or more overlay elements, and to provide name information about the overlays and overlay elements.

The playback unit 202 contains a video decoder 204, a video compositor 206, and an overlay selector interface 208. In the video decoder 204 of the player unit 202, the received encoded video 110 is received from the network or local storage 302. This video is decoded into the primary pictures 226 of the sequence of frames and auxiliary pictures 224 of the sequence of frames. The auxiliary pictures may be identified by the SEI messages from HEVC video. The playback unit may be a set-top box, smart television, or any other desired type of media player.

The video decoder receives the SEI messages and extracts information 220 about the overlays from the message. This information is presented to the viewer, through the overlay selector interface 208. The overlay selector interface is connected to a display 212 and a user input device. These may be combined into some sort of GUI 214. The display may be the same display 214 for rendering the decoded content video or it may be a separate control interface.

Using the information extracted from the SEI message or carried in some other way, the viewer may individually select the overlay elements to be displayed or not to be displayed. The GUI 214 may be used to present the names and descriptions of the overlays and of the overlay elements. By selecting these overlay elements, at the overlay selector, the viewer selects which of the corresponding object tags should be and should not be displayed.

The decoder sends the primary pictures 226 as content video 232 to the compositor 206. The decoder will also send auxiliary pictures to the decoder. Some of these auxiliary pictures may not be deselected and form a part of the final composited video images 210 that are sent to the display 212. There may be many additional auxiliary pictures sent from the decoder to the compositor.

In the content preparation unit, the editor may make some overlays selectable and other overlays not selectable. Some of the overlays may be used to properly render the content video with colors, shading, backgrounds, etc. Other overlays may be used for source, identifying, credits, or other information that should not be removed. Still other overlays may be used for optional information, tags, or enhancements. The viewer is provided with an option to select only those overlays that are optional. From one perspective, the viewer selects the overlays that are desired from among the selectable overlays. From another perspective, the viewer selects the overlays that will not be shown from among the overlays that are selectable. In many cases there may be overlays that cannot be removed by the user, depending on how the video is structured.

If at least one overlay element 238 is selected for display, then the selection information 222 from the overlay selector interface is provided to the video decoder and to the compositor. The selected overlay layer 228 and the corresponding overlay label layer 230 are decoded at the decoder as auxiliary pictures 224. The auxiliary pictures are sent from the decoder together with the primary pictures and the compositor module composites the overlay to the main content decoded video to produce a video sequence of composite pictures for viewing on the display.

The selection of overlay labels may be done in real-time during viewing, and with individual overlays being turned on and off independently. The overlay label is used with the overlay frame to select in the composition module whether or not the tag for an individual tracked object is displayed. Only those pixels of the tag overlay video corresponding to the selected overlay element are included in the composite video, as determined by the brightness value of the corresponding location in the overlay label of that frame.

FIG. 3 is a diagram of a frame of a video sequence of a sporting game in which four different people are moving across a playing field after a ball. Such a video sequence may be considered in the example in which a mother captures video of a game in which her two daughters, Laura and Jane, are playing, among others. A video editor application is then used which includes a content preparation unit such as that described above with respect to FIG. 1.

Using previous pictures of Laura and Jane as input, the video may be analyzed to identify the frames in which Laura and Jane are present. Their locations are tracked. Logo name tags for Laura and Jane may be created or retrieved from memory in which they were stored. They may be stored as GIF images or as any of a variety of other formats, and input to the tagger module. The content preparation unit creates a tag overlay video showing the appropriate logo name tags for Laura and Jane near the girls throughout the game.

An overlay label video is also created which defines a pixel brightness for the locations of the logo name tags. The locations of the name tag for Laura, for example, may have a pixel brightness value of 15, and the locations of the logo name tag for Jane have a pixel brightness of 25. The location changes with each frame as Laura and Jane move from frame to frame. The content, the tag overlay, and the overlay label videos are then encoded using HEVC version 2, or any other suitable encoder, with the tag overlay and overlay label videos coded as auxiliary pictures. All of the layers and an overlay info SEI message are included in the output bitstream.

The overlay info SEI message indicates that there are two overlay elements included in the overlay, and that the overlay element names are "Laura" and "Jane". The mother later emails the bitstream file to the children's grandparents.

At a still later time, the grandparents view the video. The video player contains the player unit, and provides a user interface which indicates that tag overlays are present, for "Laura" and "Jane". The grandparents watch the video using the video decoder in the player unit, initially without selecting to display any tag overlays. Midway through the video, they are unsure which of the players is Jane, so they use the user interface to indicate that they want to display the tag overlay for Jane. The player unit decodes the tag overlay and overlay element layer. The compositor uses the brightness values of pixels in the overlay label frame to determine which pixel positions correspond to the overlay element for Jane, and blends the tag overlay frame with the content video to create a video that shows Jane's logo name tag overlaid over the content video. A little later through the video, the grandparents then decide to also display the tag overlays for Laura, so they use the interface to also select Laura.

Once the grandparents know which players are Jane and Laura, they find the presence of the logo name tags to be distracting, so after a short while they use the user interface to unselect the display of Jane's and Laura's tag overlays, as they continue to watch the video.

FIG. 3 is a diagram of a still frame of a sports game sequence, with bounding boxes 304, 306 indicating the positions of Laura and Jane, as determined by the video analysis module.

FIG. 4 is a diagram of an overlay frame created by the tagger, which includes icons 314, 316 for Laura and Jane. The icons are positioned near the positions of the identified persons in the frame of FIG. 3. The overlay frame for the next frame in the video sequence may have the icons in another position as the icons track the movement of the two players, or any other suitable tracked object. The icons may be integrated directly into the frame of the game by overlaying the two frames one over the other because the overlay frame determines the positions of the icons. Note that this frame may be greatly compressed by the encoder because most of the pixels have no information.

Figure 5:
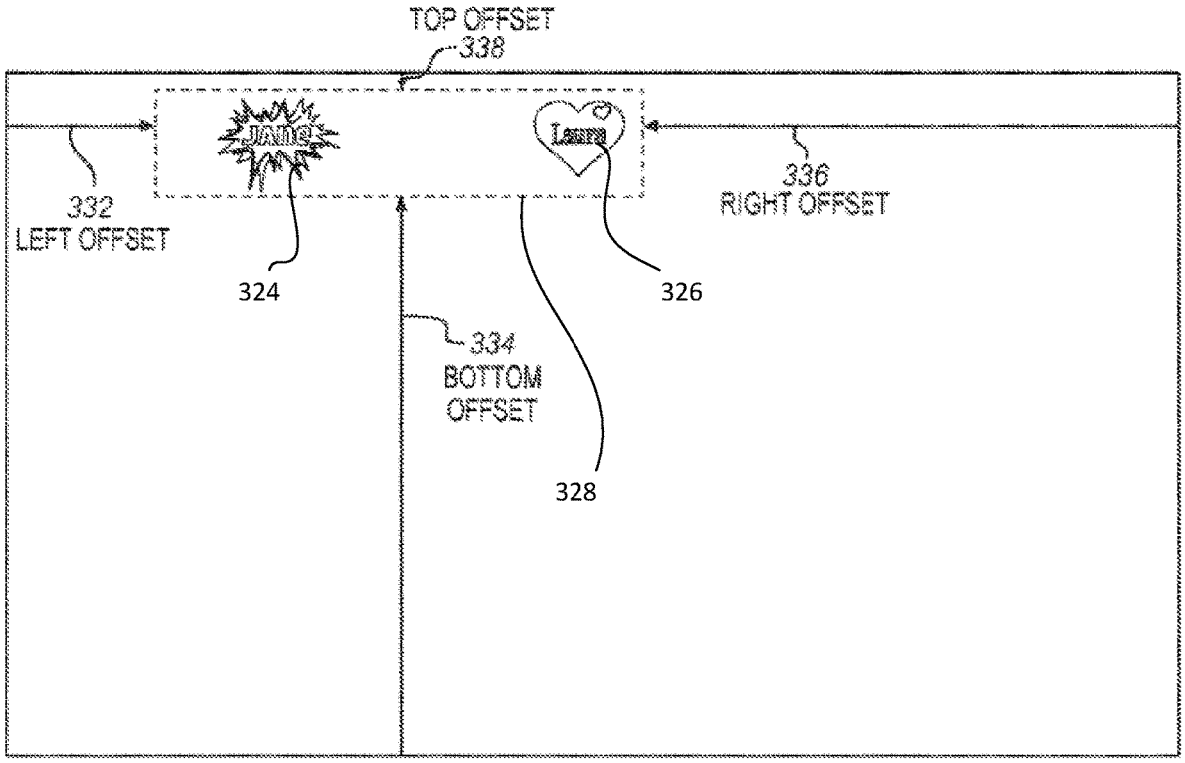
FIG. 5 is a diagram of an alternative overlay frame created by an object tagger according to an embodiment.

FIG. 5 is a diagram of a different version of the overlay frame of FIG. 4. In this example, the two icons 324, 326 are part of a much smaller image 328 that is large enough only to include the two icons. Scaled reference offsets are used to define a position for the smaller image in the larger frame. The reference offsets code the smaller overlay frame 328 with the four directions indicated, namely a left offset 332 from the left edge of the frame, a bottom offset 334 from the bottom edge of the larger frame, a right offset 336 from the right edge of the frame, and a top offset 338 from the top edge of the frame. These offsets may be modified for each successive frame of the video sequence as the players move. In the event that that two tracked objects come closer or farther apart, then the smaller image 328 may be modified to suit the distance between the two objects, in this case, the two players. FIGS. 4 and 5 are provided as examples of coding overlay frames and the embodiments herein are not so limited.

Figure 6:
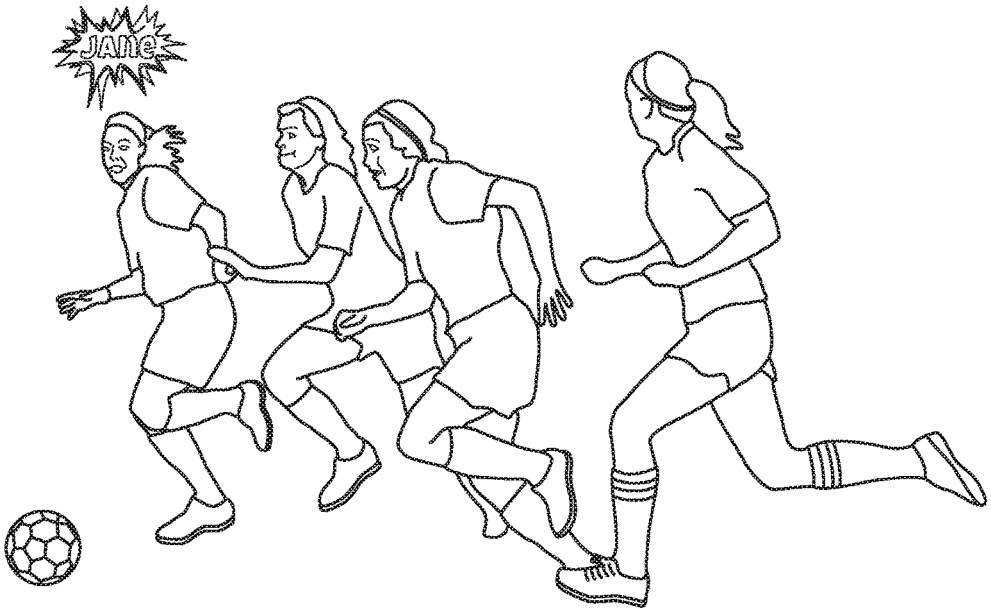
FIG. 6 is a diagram of the video frame of FIG. 3 with one selectable tagging overlay superimposed according to an embodiment.

FIG. 6 is a diagram of the same frame of the game in which the selectable overlay Jane has been selected and the selectable overlay for Laura has not been selected. This example shows what is displayed when the grandparents have selected to display only the tag for Jane.

Figure 7:
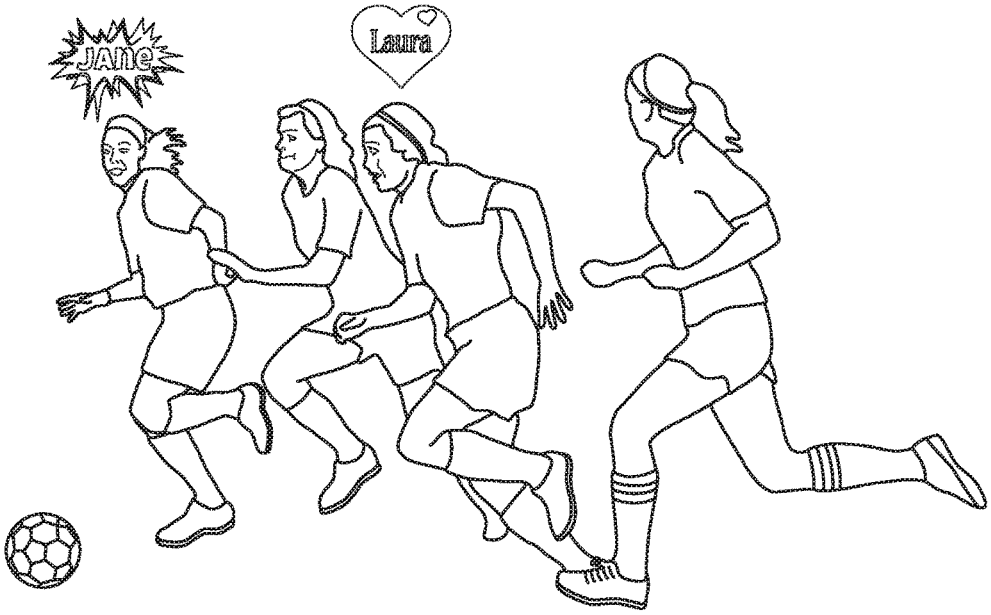
FIG. 7 is a diagram of the video frame of FIG. 3 with both selectable tagging overlays superimposed according to an embodiment.

FIG. 7 is a diagram of the same frame of the game in which both overlays have been selected. This is an example of what is displayed when the grandparents have selected to display the tags for both Jane and Laura at the same time.

The content preparation unit as described herein may be used to provide new user-controllable video tagging overlay features for video editing software and components in conjunction with face recognition and face tracking functions. The playback unit may combine a media decoder and video player which draws from locally or remotely stored video. For web-based video services, the content developers may provide several different overlays and then allow the viewer to decide which overlay to present over the watched video.

Figure 8:
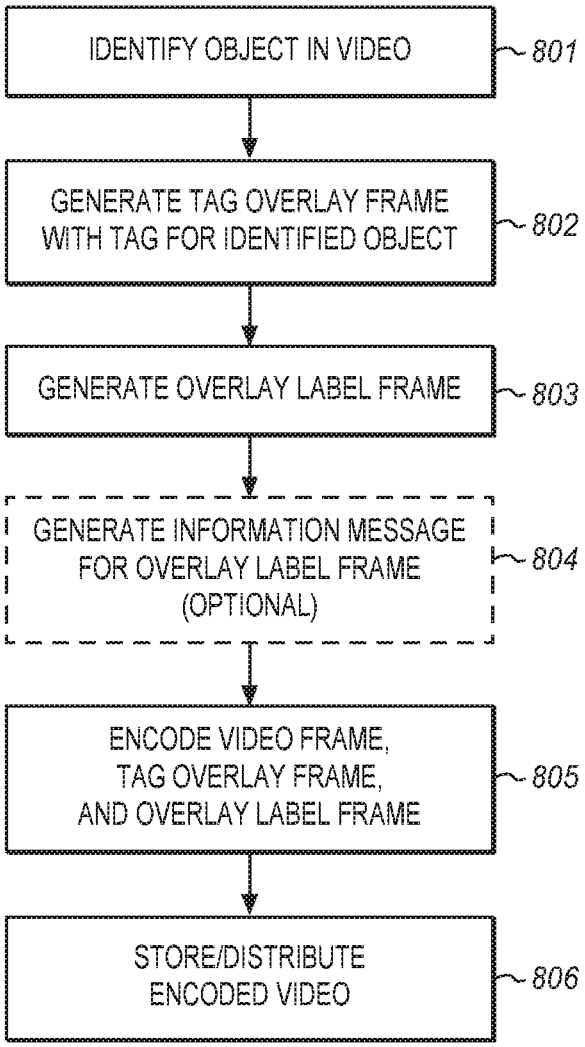
FIG. 8 is a process flow diagram of encoding video with selectable tagging overlays according to an embodiment.

FIG. 8 is a process flow diagram for encoding video with motion tracking overlays as described herein. At 801 one or more objects are identified in a sequence of video frames. There are many different way to identify an object. Facial recognition may be used to identify a known person that has already been stored in the system. An operator or editor may select a person or object and then an object tracking module may follow that object through the frames of the video sequence.

At 802 a tag overlay video frame is generated that has a visible representation of a tag. The tag may be machine generated using predetermined templates or generated by the operator. The tag may be in the form of an image such as a GIF or bitmap or in some other format. The tag overlay video frame may be generated in the form of an auxiliary picture. The auxiliary picture has a representation of the tag together with an indication of the position of the tag. The position of the tag is related to the position of the identified object. The tag may be directly over the object or beside the object offset in any direction by any desired amount. As the object moves through successive frames, the tag overlay video frame is modified after each successive frame based on the tracking. In this way the tag follows the object through the video sequence.

At 803 an overlay label frame is generated to indicate the tag of the tag overlay frame. At 804, an information message, such as a supplemental enhancement information message, may also optionally be generated to be combined into the encoded video that describes the tag.

At 805 all of these are encoded together. The video frame, the tag overlay video frame, the overlay label frame, and the information message if present, are combined into an encoded video sequence. There may be many tag overlay frames and overlay label frames. The encoded video may then be stored or distributed or both at 806.

Figure 9:
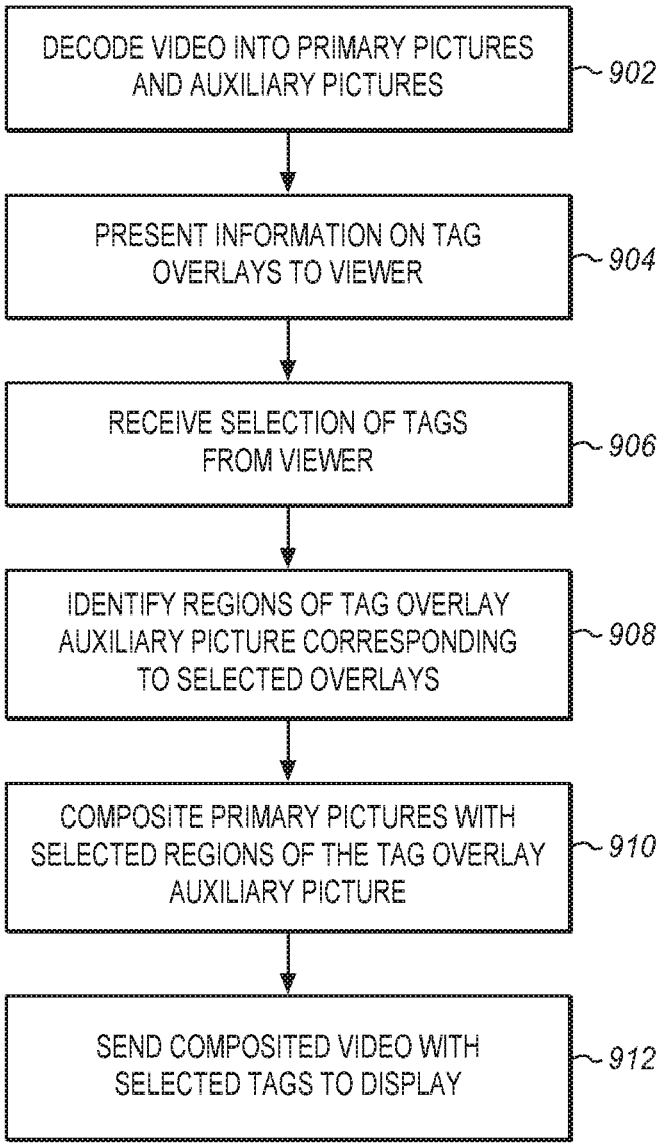
FIG. 9 is a process flow diagram of decoding video and selecting tagging overlays according to an embodiment.

FIG. 9 is a process flow diagram for decoding video with selectable overlay as described herein. At 902 a received encoded video sequence is decoded into primary pictures and auxiliary pictures.

At 904 information regarding the auxiliary pictures is presented to a viewer. The auxiliary pictures have overlays and overlay labels. The overlay labels provide the viewer with an opportunity to decide which overlays should be displayed and which overlays should not be displayed. The user may then select or de-select the tags to be displayed through a GUI or some other approach.

The viewer selections may be helped using information messages. The encoded video may include information messages about the tag overlays in which case, the decoder decodes an information message that describes the auxiliary pictures and in particular any selectable tags. The information from this message is then presented to the viewer for use in selecting tags to be displayed or not to be displayed. The information may include names and descriptions of the respective tags, e.g. overlay elements.

At 906 a selection is received from the viewer of one or more of the selectable tags that correspond to the tag overlays that were presented for selection. At 908 in response to receiving this selection, the regions of the tag overlay auxiliary picture corresponding to the selected overlay is identified. The region may be only a small part of the overall picture or frame as shown for example in FIG. 5 or a much larger part. At 910 the primary pictures are composited with the selected regions of the tag overlay auxiliary picture and without the deselected auxiliary pictures to produce a composited video with the selected tags. At 912, the composited video is sent to a video display for viewing. As described above, the selected tags will be shown in the displayed video.

Figure 10:
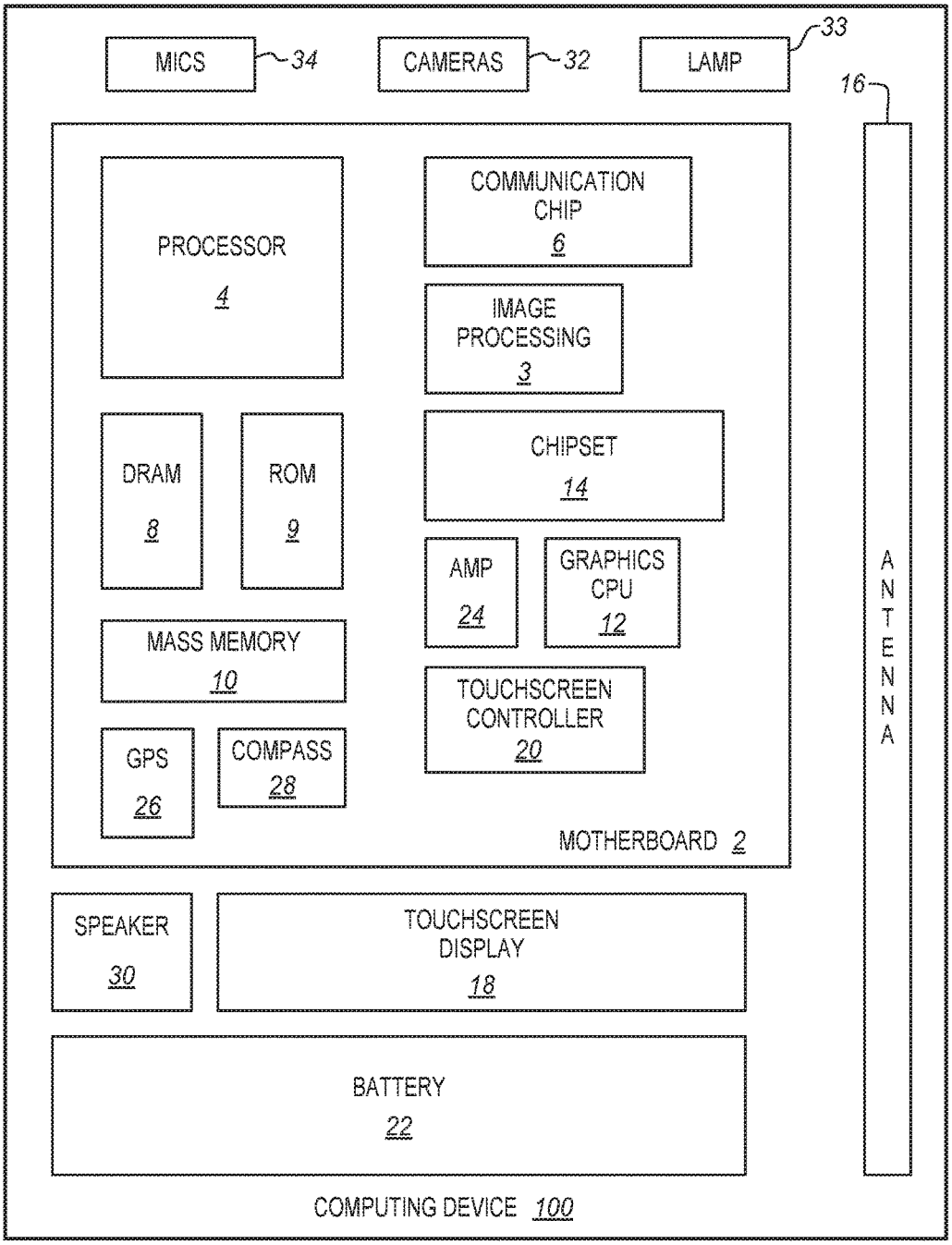
FIG. 10 is a block diagram of a computing device video encoding and decoding according to an embodiment

FIG. 10 is a block diagram of a computing device 100 in accordance with one implementation. The computing device 100 houses a system board 2. The board 2 may include a number of components, including but not limited to a processor 4 and at least one communication package 6. The communication package is coupled to one or more antennas 16. The processor 4 is physically and electrically coupled to the board 2.

Depending on its applications, computing device 100 may include other components that may or may not be physically and electrically coupled to the board 2. These other components include, but are not limited to, volatile memory (e.g., DRAM) 8, non-volatile memory (e.g., ROM) 9, flash memory (not shown), a graphics processor 12, a digital signal processor (not shown), a crypto processor (not shown), a chipset 14, an antenna 16, a display 18 such as a touchscreen display, a touchscreen controller 20, a battery 22, an audio codec (not shown), a video codec (not shown), a power amplifier 24, a global positioning system (GPS) device 26, a compass 28, an accelerometer (not shown), a gyroscope (not shown), a speaker 30, a camera 32, a lamp 33, a microphone array 34, and a mass storage device (such as a hard disk drive) 10, compact disk (CD) (not shown), digital versatile disk (DVD) (not shown), and so forth). These components may be connected to the system board 2, mounted to the system board, or combined with any of the other components.

The communication package 6 enables wireless and/or wired communications for the transfer of data to and from the computing device 100. The term "wireless" and its derivatives may be used to describe circuits, devices, systems, methods, techniques, communications channels, etc., that may communicate data through the use of modulated electromagnetic radiation through a non-solid medium. The term does not imply that the associated devices do not contain any wires, although in some embodiments they might not. The communication package 6 may implement any of a number of wireless or wired standards or protocols, including but not limited to Wi-Fi (IEEE 802.11 family), WiMAX (IEEE 802.16 family), IEEE 802.20, long term evolution (LTE), Ev-DO, HSPA+, HSDPA+, HSUPA+, EDGE, GSM, GPRS, CDMA, TDMA, DECT, Bluetooth, Ethernet derivatives thereof, as well as any other wireless and wired protocols that are designated as 3G, 4G, 5G, and beyond. The computing device 100 may include a plurality of communication packages 6. For instance, a first communication package 6 may be dedicated to shorter range wireless communications such as Wi-Fi and Bluetooth and a second communication package 6 may be dedicated to longer range wireless communications such as GPS, EDGE, GPRS, CDMA, WiMAX, LTE, Ev-DO, and others.

The cameras 32 capture video as a sequence of frames as described herein. The image sensors may use the resources of an image processing chip 3 to read values and also to perform exposure control, shutter modulation, format conversion, coding and decoding, noise reduction and 3D mapping, etc. The processor 4 is coupled to the image processing chip and the graphics CPU 12 is optionally coupled to the processor to perform some or all of the process described herein for the content preparation unit. Similarly, the video playback unit and GUI may use a similar architecture with a processor and optional graphics CPU to render video from the memory, received through the communications chip or both.

In various implementations, the computing device 100 may be eyewear, a laptop, a netbook, a notebook, an ultrabook, a smartphone, a tablet, a personal digital assistant (PDA), an ultra mobile PC, a mobile phone, a desktop computer, a server, a set-top box, an entertainment control unit, a digital camera, a portable music player, or a digital video recorder. The computing device may be fixed, portable, or wearable. In further implementations, the computing device 100 may be any other electronic device that processes data.

Embodiments may be implemented as a part of one or more memory chips, controllers, CPUs (Central Processing Unit), microchips or integrated circuits interconnected using a motherboard, an application specific integrated circuit (ASIC), and/or a field programmable gate array (FPGA).

References to "one embodiment", "an embodiment", "example embodiment", "various embodiments", etc., indicate that the embodiment(s) so described may include particular features, structures, or characteristics, but not every embodiment necessarily includes the particular features, structures, or characteristics. Further, some embodiments may have some, all, or none of the features described for other embodiments.

In the following description and claims, the term "coupled" along with its derivatives, may be used. "Coupled" is used to indicate that two or more elements co-operate or interact with each other, but they may or may not have intervening physical or electrical components between them.

As used in the claims, unless otherwise specified, the use of the ordinal adjectives "first", "second", "third", etc., to describe a common element, merely indicate that different instances of like elements are being referred to, and are not intended to imply that the elements so described must be in a given sequence, either temporally, spatially, in ranking, or in any other manner.

The drawings and the forgoing description give examples of embodiments. Those skilled in the art will appreciate that one or more of the described elements may well be combined into a single functional element. Alternatively, certain elements may be split into multiple functional elements. Elements from one embodiment may be added to another embodiment. For example, orders of processes described herein may be changed and are not limited to the manner described herein. Moreover, the actions of any flow diagram need not be implemented in the order shown; nor do all of the acts necessarily need to be performed. Also, those acts that are not dependent on other acts may be performed in parallel with the other acts. The scope of embodiments is by no means limited by these specific examples. Numerous variations, whether explicitly given in the specification or not, such as differences in structure, dimension, and use of material, are possible. The scope of embodiments is at least as broad as given by the following claims.

The following examples pertain to further embodiments. The various features of the different embodiments may be variously combined with some features included and others excluded to suit a variety of different applications. Some embodiments pertain to a method that includes identifying an object in a sequence of video frames, generating a tag overlay video frame having a visible representation of a tag in a position which is related to the position of the identified object, generating an overlay label frame to indicate pixel positions corresponding to the tag of the tag overlay frame, and encoding the video frame, the tag overlay video frame and the overlay label frame in an encoded video sequence.

Further embodiments include tracking the identified object through frames of the sequence and modifying the tag overlay video frame based on the tracking.

Further embodiments include receiving a user identification of objects to track and wherein tracking the identified object comprises tracking the object identified by the user.

In further embodiments identifying an object comprises using facial recognition to identify a known person.

In further embodiments generating a tag overlay frame comprises determining a position of the identified object, associating a tag with the identified object, and determining a position of the tag based on the position of the identified object.

In further embodiments determining a position of the tag comprises adding an offset to the position of the identified object.

In further embodiments the tag overlay video frame comprises an auxiliary picture, the auxiliary picture comprising a representation of the tag.

Further embodiments include generating an information message that describes the tag and wherein encoding comprises encoding the information message in the encoded video sequence.

Some embodiments pertain to an apparatus that includes a video object identification module to identify an object in a sequence of video frames, a tagger to generate a tag overlay video frame having a visible representation of a tag in a position which is related to the position of the identified object and an overlay label frame to indicate pixel positions corresponding to the tag of the tag overlay frame, and a video encoder to encode the video frame, the tag overlay video frame and the overlay label frame in an encoded video sequence.

In further embodiments the object identification module tracks the identified object through frames of the sequence and wherein the tagger modifies the tag overlay video frame based on the tracking.

Further embodiments include a user interface to receive a user identification of objects to track and wherein the object identification module tracks the identified object by tracking the object identified by the user.

Some embodiments pertain to a method that includes decoding a received encoded video sequence into primary pictures and auxiliary pictures, the auxiliary pictures comprising tag overlay frames and overlay label frames, the overlay label frames each being associated with a tag overlay frame and having values corresponding to tags of the associated tag overlay frame, presenting information regarding the tag overlay video frames and overlay label frames to a viewer, receiving a selection of a tag from the viewer, identifying regions of the tag overlay frames from the overlay label frame values corresponding to the selected tag, compositing the primary pictures with auxiliary pictures that include the identified regions of the tag overlay frames to produce a composited video with the selected tags, and sending the composited video to a display.

In further embodiments presenting information comprises presenting a tag and a tag label from the overlay label frames.

Further embodiments include decoding an information message that describes the auxiliary pictures and presenting the information message to the viewer for use in selecting a tag.

In further embodiments the information message has names and descriptions of the overlay label frames.

Further embodiments include receiving a selection of a second tag to include in the composited video, and identifying regions of a tag overlay frame corresponding to the selected second tag, wherein compositing comprises compositing the primary pictures with auxiliary pictures that include the identified regions of the tag overlay frame corresponding to the second tag.

Further embodiments include presenting the composited video and the selected tags on a video display.

Some embodiments relate to a playback system that includes a video decoder coupled to a video storage network to receive an encoded video sequence, and to decode the received encoded video sequence into primary pictures and auxiliary pictures, the auxiliary pictures comprising tag overlay frames and overlay label frames, the overlay label frames each being associated with a tag overlay frame and having values corresponding to tags of the associated tag overlay frame, an overlay selector interface to present information regarding the tag overlay video frames and overlay label frames to a viewer and to receive a selection of a tag from the viewer, identifying regions of the tag overlay frames from the overlay label frame values corresponding to the selected tag, compositing the primary pictures with auxiliary pictures that include the identified regions of the tag overlay frames to produce a composited video with the selected tags, and sending the composited video to a display.

In further embodiments the overlay selector interface presents a tag and a tag label from the overlay label frames.

In further embodiments the video decoder further decodes an information message that describes the auxiliary pictures with names and descriptions of the overlay label frames and wherein the overlay selector interface presents the information message to the viewer for use in selecting a tag.

Some embodiments pertain to a computer-readable medium having instructions stored thereon for performing any one or more of the operations of the embodiments above.

Some embodiments pertain to an apparatus having means for performing any one or more of the operations of the embodiments above.

What is claimed is:

1. A method comprising:

identifying, in a sequence of video frames, a first object and a second object;

generating a sequence of tag overlay video frames having a visible representation of both (i) a first tag in a position which is related to the position of the identified first object, and (ii) a second tag in a position which is related to a position of the identified second object, wherein each of a plurality of tag overlay video frames of the sequence of tag overlay video frames comprises (i) the first tag, (ii) the second tag, and (iii) a space between the first and second tag;

tracking the identified first and second objects through the sequence of video frames;

modifying an offset associated with one or more tag overlay video frames in the sequence of tag overlay video frames, based on the tracking;

modifying a size of one or more tag overlay video frames, based on a change in a size of the space between the first and second tag, without modifying a size of at least one of the first tag or the second tag;

generating a sequence of overlay label frames to indicate pixel positions corresponding to the tag in the sequence of the tag overlay frames; and encoding the sequence of video frames, the sequence of tag overlay video frames, and the sequence of overlay label frames in an encoded video sequence.

2. The method of claim 1, further comprising receiving a user identification of objects to track and wherein tracking the identified object comprises tracking the object identified by the user.

3. The method of claim 1, wherein identifying an object comprises using facial recognition to identify a known person.

4. The method of claim 1, wherein generating a tag overlay frame comprises:

determining the positions of the identified first and second objects;

associating the first tag with the identified first object and the second tag with the identified second object; and determining the positions of the first and second tags based on the positions of the identified first and second objects.

5. The method of claim 1, wherein determining a position of the tag comprises adding the offset to the position of the identified first or second object.

6. The method of claim 1, wherein the tag overlay video frames comprise an auxiliary picture, the auxiliary picture comprising a representation of the first and/or second tags.

7. The method of claim 1, further comprising generating an information message that describes the tag and wherein encoding comprises encoding the information message in the encoded video sequence.

8. The method of claim 1, wherein the offset is a first offset, the method further comprising:

defining a position of a tag overlay video frame relative to a video frame using at least the first offset and a second offset; and changing values of the first offset and the second offset, when the position of the tag overlay video frame changes throughout the sequence of video frames.

9. The method of claim 1, wherein modifying the size of the one or more tag overlay video frames comprises:

modifying the size of the one or more tag overlay video frames in the sequence of tag overlay video frames, based on the tracking.

10. The method of claim 9, wherein the size of the tag overlay video frames is modified based on a change of position of the first tag relative to a position of the second tag.

11. An apparatus comprising:

a video object identification module to identify and track a first object and a second object in a sequence of video frames;

a tagger to generate a sequence of tag overlay video frames having a visible representation of both (a) a first tag in a first position which is related to the position of the identified first object and (b) a second tag in a second position which is related to the position of the identified second object, wherein the tagger is further to generate an overlay label frame to indicate pixel positions corresponding to the first and second tags of the tag overlay frames, and wherein the tagger is further to modify a size of one or more tag overlay video frames, based on a change in a space between the first and second tag, without modifying a size of at least one of the first tag or the second tag; and a video encoder to encode the video frame, the tag overlay video frame and the overlay label frame in an encoded video sequence.

12. The apparatus of claim 11, further comprising a user interface to receive a user identification of objects to track, wherein the video object identification module tracks the identified objects by tracking the objects identified by the user.

13. A method comprising:

decoding a received encoded video sequence into primary pictures and auxiliary pictures, the auxiliary pictures comprising tag overlay frames and overlay label frames, the overlay label frames each being associated with a respective tag overlay frame and having values corresponding to tags of the associated tag overlay frame, wherein an overlay label frame includes information about (i) a first offset of a corresponding tag overlay frame relative to a first edge of a frame of the primary picture and (ii) a second offset of the corresponding tag overlay frame relative to a second edge of the frame of the primary picture, wherein a sequence of the tag overlay video frames has a visible representation of (i) a first tag, (ii) a second tag, and (iii) a space between the first and second tag, and wherein a size of one or more tag overlay video frames changes, based on a change in the space between the first and second tag, without a change of at least one of the first tag or the second tag;

presenting information regarding the tag overlay video frames and overlay label frames to a viewer;

receiving a selection of a tag from the viewer;

identifying regions of the tag overlay frames from the overlay label frame values corresponding to the selected tag;

compositing the primary pictures with auxiliary pictures that include the identified regions of the tag overlay frames to produce a composited video with the selected tags; and sending the composited video to a display.

14. The method of claim 13, wherein presenting information comprises presenting a tag and a tag label from the overlay label frames.

15. The method of claim 13, further comprising decoding an information message that describes the auxiliary pictures and presenting the information message to the viewer for use in selecting a tag, wherein the information message has names and descriptions of the overlay label frames.

16. The method of claim 13, further comprising:

receiving a selection of a tag to include in the composited video; and identifying regions of a tag overlay frame corresponding to the selected tag, wherein compositing comprises compositing the primary pictures with auxiliary pictures that include the identified regions of the tag overlay frame corresponding to the second tag.

17. The method of claim 13, further comprising presenting the composited video and the selected tags on a video display.

18. A playback system comprising:

a video decoder coupled to a video storage network to receive an encoded video sequence, and to decode the received encoded video sequence into primary pictures and auxiliary pictures, the auxiliary pictures comprising tag overlay frames and overlay label frames, the overlay label frames each being associated with a tag overlay frame and having values corresponding to tags of the associated tag overlay frame, wherein a plurality of tag overlay video frames have a visible representation of (i) a first tag, (ii) a second tag, and (iii) a space between the first and second tag, and wherein a size of one or more tag overlay video frames changes, based on a change in the space between the first and second tag, without a change in size of at least one of the first tag or the second tag;

an overlay selector interface to present information regarding the tag overlay video frames and overlay label frames to a viewer and to receive a selection of a tag from the viewer;

identifying regions of the tag overlay frames from the overlay label frame values corresponding to the selected tag, wherein an overlay label frame defines a position of the tag overlay video frame relative to a frame of the primary pictures using at least a first offset and a second offset;

compositing the primary pictures with auxiliary pictures that include the identified regions of the tag overlay frames to produce a composited video with the selected tags; and sending the composited video to a display.

19. The system of claim 18, wherein the overlay selector interface presents a tag and a tag label from the overlay label frames, and wherein the video decoder further decodes an information message that describes the auxiliary pictures with names and descriptions of the overlay label frames and wherein the overlay selector interface presents the information message to the viewer for use in selecting a tag.

20. The system of claim 18, wherein:

the size of the tag overlay frame changes over a sequence of the auxiliary pictures, the change in size based on a position of the first tag relative to the second tag.

* * * * *